US007434270B1

(12) United States Patent
Bradford

(10) Patent No.: US 7,434,270 B1
(45) Date of Patent: Oct. 14, 2008

(54) PROTECTIVE GARMENT AND GLOVE ASSEMBLY

(75) Inventor: Kelly Bradford, Decatur, AL (US)

(73) Assignee: Lakeland Industries, Inc., Ronkonkoma, NY (US)

( * ) Notice: Subject to any disclaimer, the term of this patent is extended or adjusted under 35 U.S.C. 154(b) by 533 days.

(21) Appl. No.: 11/021,589

(22) Filed: Dec. 22, 2004

Related U.S. Application Data

(63) Continuation-in-part of application No. 10/737,620, filed on Dec. 15, 2003, now Pat. No. 7,225,470.

(51) Int. Cl.
*B64G 6/00* (2006.01)

(52) U.S. Cl. ..... 2/59; 2/159

(58) Field of Classification Search ..... 2/59, 2/159, 2.11, 456, 242, 270, 232, 69, 79, 227, 2/22, 69.5, 2.14, 2.15, 911, 919, 81, 82; 36/1.5, 36/2 R See application file for complete search history.

(56) References Cited

U.S. PATENT DOCUMENTS

| | | | | |
|---|---|---|---|---|
| 4,864,742 | A * | 9/1989 | Grilliot et al. | 36/109 |
| 5,068,919 | A * | 12/1991 | MacKendrick et al. | 2/2.12 |
| 6,141,802 | A * | 11/2000 | Drake | 2/227 |
| 6,374,414 | B1 * | 4/2002 | Collier | 2/69 |
| 6,748,609 | B1 * | 6/2004 | Garigan | 2/457 |
| 7,225,470 | B1 * | 6/2007 | Bradford | 2/2.11 |

* cited by examiner

*Primary Examiner*—Tejash Patel
(74) *Attorney, Agent, or Firm*—John Lezdey & Assoc.

(57) ABSTRACT

A protective garment having gloves at the bottom of sleeve portions which can be quickly attached and detached. The gloves contain an attachment ring which sealingly mates with a respective attachment ring on the sleeve portions by a bayonet attachment. There is also provided a kit for retrofitting existing gloves and protective garments. An outer glove is attachable over an inner glove which can be changed by alternate pair of gloves.

12 Claims, 5 Drawing Sheets

PROTECTIVE GARMENT AND GLOVE ASSEMBLY

RELATED APPLICATION

This application is a Continuation-in-Part of application Ser. No. 10/737,620 Filed Dec. 15, 2003 now U.S. Pat. No. 7,225,470.

FIELD OF THE INVENTION

The present invention relates to the combination of safety gloves and clothing which are used by sportsmen, military, firemen, and the like that provide protection from the environment. More particularly, there is provided a quick release of protection gloves from a protective garment and a choice of gloves.

BACKGROUND OF THE INVENTION

The military, in a dangerous environment such as hazardous gas, generally don protective garment to cover the hands and the person. This creates a problem that the glove portion of the garment would be abraded so as to provide a leak into the garment. Also, the fingers are inhibited from properly handling a weapon. It would be preferable to have protective gloves which can be quickly attached and detached from a protective garment with different types of gloves since the hazardous environment usually occurs unexpectedly.

Firemen generally wear protective gloves and wear protective garments in an atmosphere which is generally expected because of a previous warning. In such cases it is preferred to be able to quickly attach a protective garment to particular protective type of glove and to easily detach them for easy and quick removal so as to decontaminate the items if required. Finger dexterity is sometimes required so that a change of glove must be made.

SUMMARY OF THE INVENTION

The present invention provides a means for modifying existing protective garments or new manufacture to provide a combination with protective gloves which can be quickly attached to change to or release from a protective garment. More particularly, there is provided an attachment for a protective garment and an attachment to the hand portions of a protective garment which protects the hands and creates a seal against liquids and gases and provides a choice of protection. Accordingly, there is provided an attachment to the protective by a ring which bayonets into a sealed position with a mating ring attached on the top of the glove portion.

More particularly there is provided a protective garment with a first pair of protective gloves attached to the sleeve portion by a first attachment ring. A second attachment ring having a second pair of protective gloves attached to said second attachment ring and covering the first pair of gloves when the rings are attached. One of said attachment rings having at least one L-shaped slot and the other attachment rings having at least one tab so as to seal and unseal the rings by a twisting motion so as to lock by a bayonet arrangement.

The kind of attachment of the rings to the protective garment and the band portion can be made depending on the activity of the user.

Advantageously, a plurality of gloves are available depending upon the activity of the wearer.

It is therefore a general object of the invention to provide a means for connection and disconnection of protective gloves from a protective garment.

It is another object of the invention to provide a means for modifying existing protective garments with gloves with a quick release mechanism.

It is a further object of the invention to provide an attachment and detachment means for gloves of protective garments which will survive rough and strenuous activity without forming a leak.

It is yet another object of the invention to provide protective gloves for different purposes.

These and other objects and advantages will become more apparent from a reading of the preferred embodiments and from the drawings.

The term "bayonet" as used herein refers to an attachment between two parts in which one part has tabs and the other part has an L-shaped slot which mates the parts together.

DESCRIPTION OF THE PREFERRED EMBODIMENTS

According to the present invention there is provided a glove and sleeve assembly for protective garments which can be assembled at the time of manufacture of the protective garment or provided in a kit with all the components to modify existing protective garments which have separable gloves.

Figure 1:
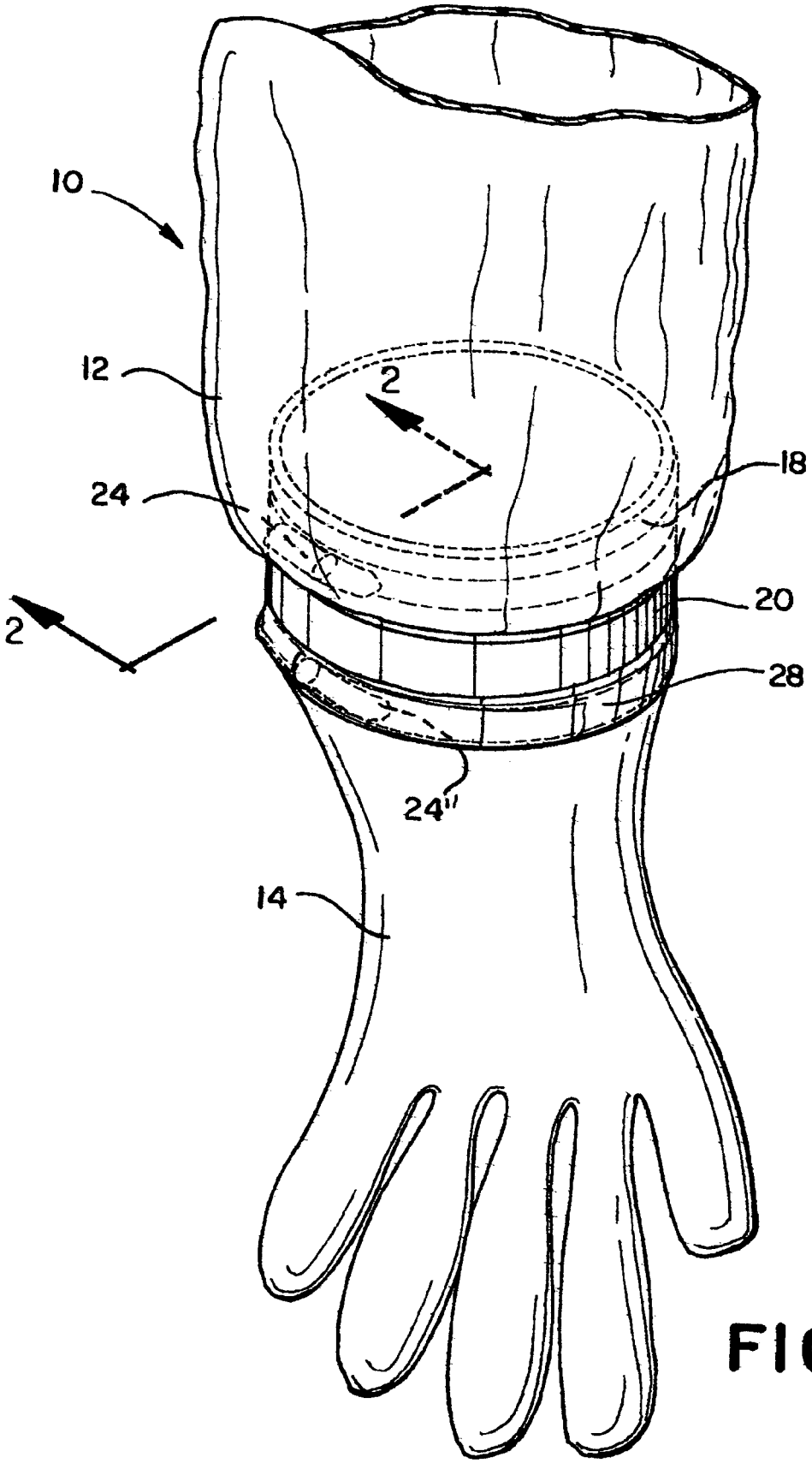
FIG. 1 illustrates the sleeve and glove assembly of the present invention with the inner glove.

As shown in FIG. 1 a sleeve and glove assembly (10) is shown in its simplest form. An upper sealing ring (18) is attached to the cuff (14*a*) of a sleeve (12) of a protective garment. A mating lower sealing ring (20) is attached to a glove (14) which is an outer glove. One of the rings (18, 20) is provided with a bayonet slot (not shown) and the other ring with a tab (not shown) so that a twist of a ring seals the parts (18, 20) together. A groove in one of the rings (not shown) contains an o-ring to provide an effective seal against gas. The rings (18, 20) can be attached to their respective parts depending on the place of manufacture or modification by way of a kit containing the components for attachment. The simplest form is to adhere the rings (18, 20) to their respective parts by adhesive. Preferably the adhesive is a high strength epoxy adhesive or the parts are sonic bonded. To provide additional protection to prevent release, a clamp (24) may be used to hold the cuff in place and another clamp ($\mathbf{24}^1$) may be used to hold the outer glove.

Figure 2:
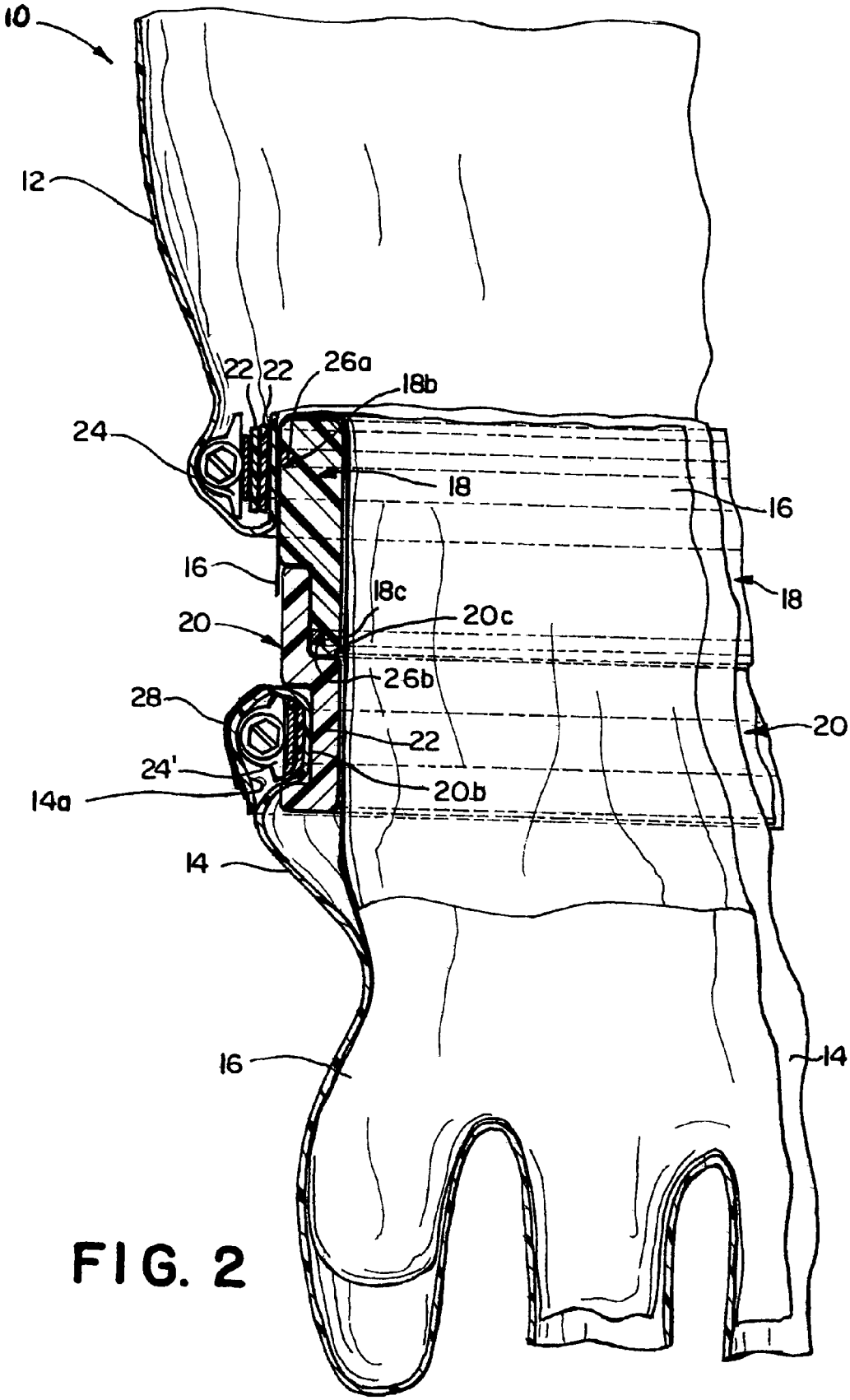
FIG. 2 is a sectional view taken along line 2-2 of FIG. 1 with the outer glove.

FIG. 2 illustrates an embodiment of the invention wherein the cuff of sleeve 12 is folded over ring (18) and held in place by a clamp (24). Optionally rubber bands (22) or any elastic band may be placed under or over the clamp (24) so as to prevent an inadvertent tear. Ring (18) has a groove (18*b*) which holds an o-ring (26*a*) for forming a seal. Fastened to the ring (18) is a chemical protective glove (16) which is the inner glove of the glove assembly. Glove (16) can be adhered by an adhesive or held by clamp (24). The inner glove preferably allows for manual dexterity of the hand.

Similarly, lower ring (20) has a clamp ($24^1$) which holds the outer glove (14). In lieu of or in additional to the clamp ($24^1$) the glove (14) can be held on the ring (20) by adhesive means. An elastic band (22) may be placed under the clamp ($24^1$) to prevent accidental tears. Also, optionally a tape (28) can be placed over clamp $24^1$). Lower ring (20) also contains a groove (18*c*) in which o-ring (26*b*) is placed to form a seal with ring (18).

Clamps (24, $24^1$) have a mechanical locking mechanism ($24^{11}$).

It should be understood that the optional materials are used as added precautions and depend on the type of clamp and locking mechanism used. The principal feature comprises the ring (18) which retains the sleeve cuff and inner glove (16) which provides a seal and locking fit by a bayonet arrangement with ring (20).

Figure 3A:
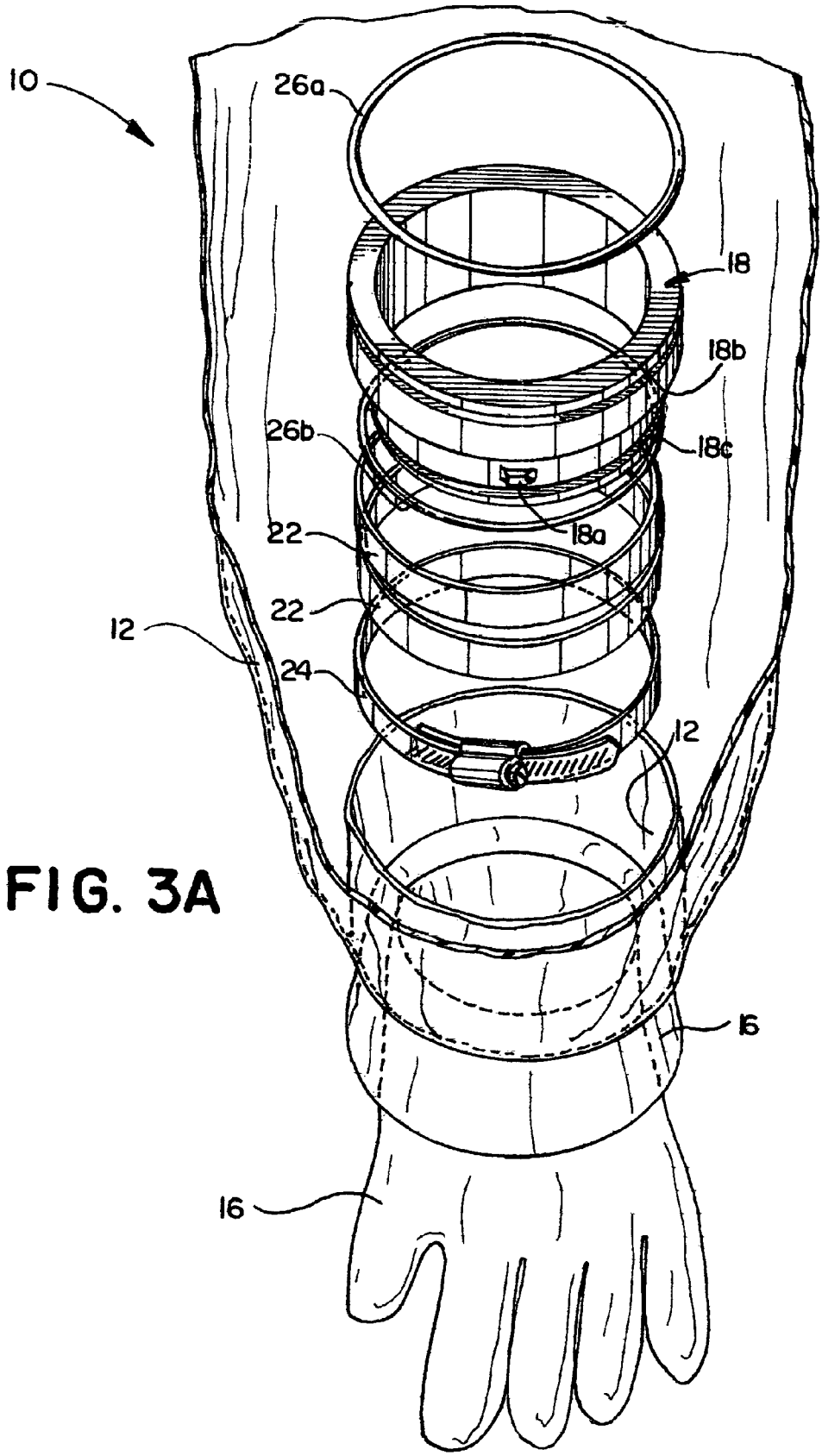
FIG. 3A is an exploded view of the sleeve and glove assembly of FIG. 1.
Figure 3B:
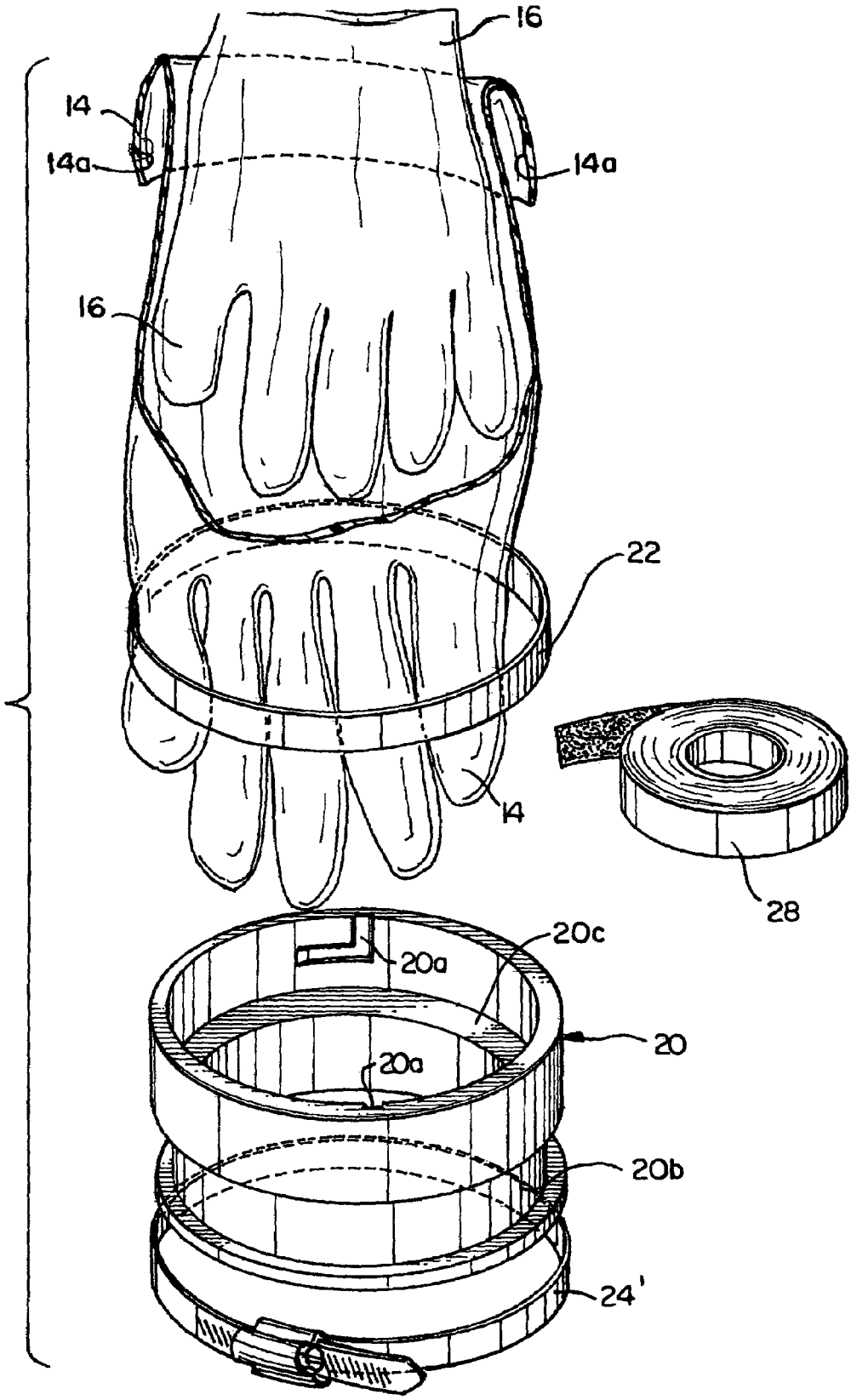
FIG. 3B is an exploded view of the lower ring attachment with the outer and inner glove.

FIGS. 3A and 3B illustrate the components in a kit for modifying existing garment and protective glove arrangement. In FIG. 3A the ring (18) contains on its outside at least one locking tab (18*a*) which is intended to mate in bayonet fit with a slot in ring (20). The outside of ring (18) is a groove (18*b*) wherein sleeve (12) has a cuff (14*a*) which is prepared and placed over the outside of ring (18) and an o-ring (26*a*) is placed over the cuff and pressed into the groove (18*b*). Adhesive can also be used to adhere the cuff to the ring (18). A clamp (24) is then tightened over the cuff to hold the sleeve securely to the ring (18). Between the cuff and the clamp (24*a*) a protective covering (22) under and over the clamp (22) to prevent the clamp from inadvertently tearing the sleeve (12). The protective covering (22) may be a rubber or elastic band or tape. As shown in FIG. 2 the inner glove (16) is also attached to the sleeve assembly by means of clamp (24).

The term "protective garment" includes shirts, coveralls, and the like which are conventional plastic materials used by the military and firemen in hazardous atmospheres.

It is understood that the rings and accessories can be provided in a kit so that individuals can retrofit existing protective garments and boots.

While particular embodiments of the present invention has been illustrated and described, it will be obvious to those skilled in the art that various changes and modifications can be made without departing from the spirit and scope of the invention, and it is intended to cover the appended claims all such modifications that are within the scope of this invention.

As seen in FIG. 3B, the outer glove (14) with cuff (14*a*) is fitted on ring (20) by sliding it over the bottom of the ring (20) and held in place with an elastic band (22) in groove (20*b*). A clamp ($24^1$) with mechanical locking means is placed over the elastic band (22). The cuff (14*a*) is folded over the clamp ($24^1$) and held over the clamp ($24^1$) by means of a tape (28). Optionally, an adhesive can be used in groove (20*b*) and to hold cuff (14A) over the clamp ($24^1$).

Ring (20) has a pair of slots (20*a*) which mates with tabs (18*a*) of ring (18) to lock the rings (18) and (20) together by twisting in a bayonet arrangement. The ledge (20*c*) together with the O-ring (26*b*) in groove (18*c*) of ring (18) provide an effective seal.

Figure 4:
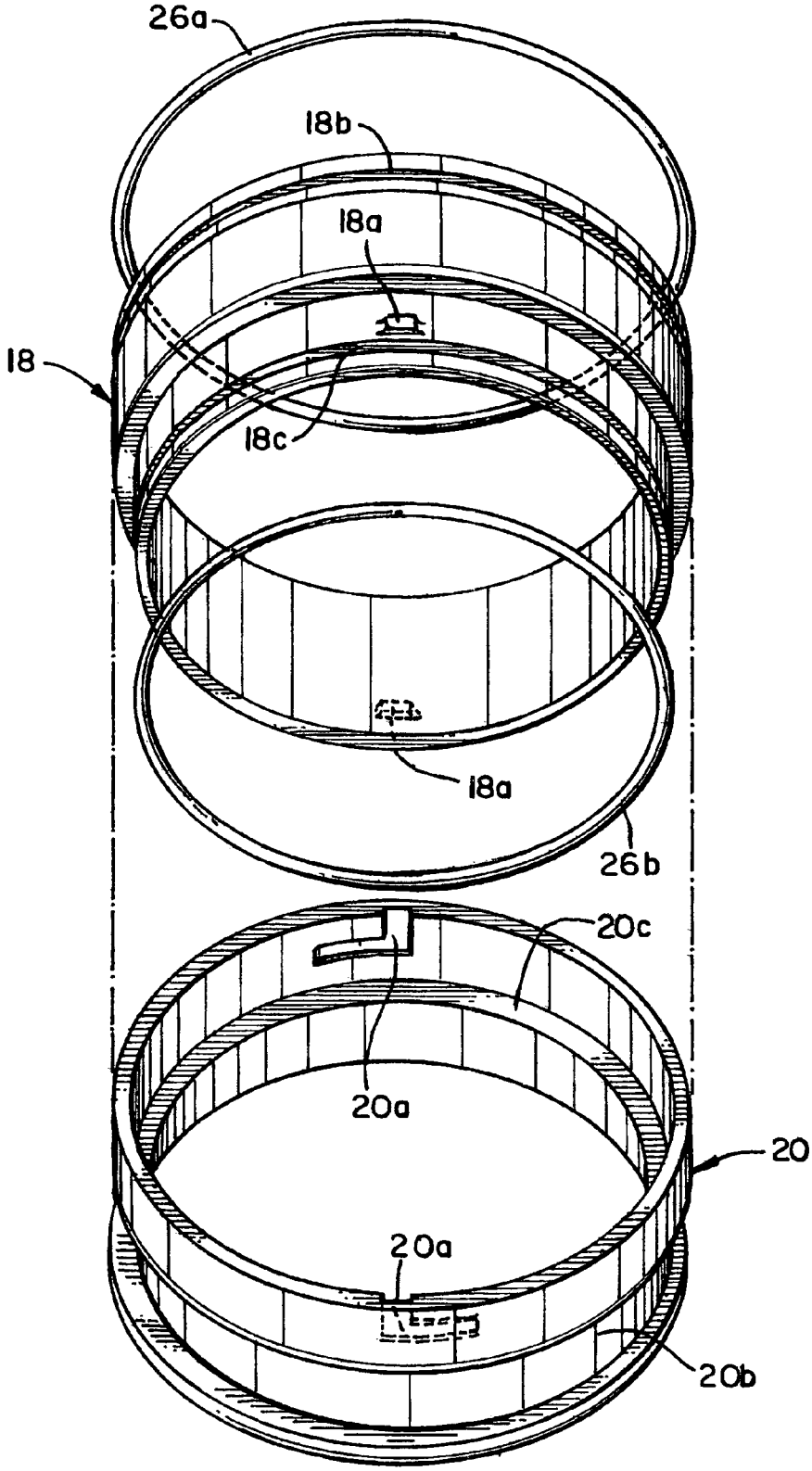
FIG. 4 is an exploded view of the upper and lower rings showing the bayonet locking device.

FIG. 4 shows the arrangement of rings (18) and (20) and the O-ring seals. Ring (18) has a groove (18*b*) for holding the inner glove (16) and O-ring (26*a*). At the bottom of ring (18) is a groove (18*c*) which hold O-ring (26*b*). In ring (20) the groove (20*b*) holds the outer glove (14) and clamp (241).

The inner glove (16) is preferably a thin chemically resistant polymer which allows for manual dexterity. Glove (16) can comprise brutyl rubber, ethyl vinyl alcohol, Surlyn®, and the like. The outer glove (14) preferably provide the abrasion resistance and protection against most chemicals or pathogen. Glove (14) can be a set of different gloves depending on the use in different temperatures or hazards. Glove (14) can comprise a thicker Surlyn®, ethyl vinyl alcohol, coated gloves to prevent electrical shock, fire resistant materials or for use in cold temperature.

The combination of gloves and protective garment can be made at a manufacturing place or a kit can be provided to retrofit existing gloves and protective garments.

What is claimed is:

1. In a protective garment having protective gloves attached at the bottom of the sleeve portions, the improvement which comprises a first pair of protective gloves attached to the sleeve portions by a first ring attachment, a second pair of protective rings having a second pair of protective gloves which is thicker than the first pair of gloves attached to said second pair of rings, one of said attachment rings having at least one L-shaped slot and the other pair of attachment rings having at least one tab so as to seal and unseal the rings when the rings are twisted into a bayonet arrangement when the slots and tabs are aligned, said second pair of gloves being optionally replaceable by a third pair of gloves attached to a third pair of attachment rings and o-rings forming a seal between said first pair of attachment rings and said second pair of attachment rings.

2. The protective garment of claim 1 wherein said second pair of gloves is attached to said second pair of attachment rings by clamps.

3. The protective garment of claim 1 including adhesive means for attaching said first and second pair of gloves.

4. The protective garment of claim 1 wherein said attachment rings are plastic.

5. The protective garment of claim 1 wherein one pair of attachment rings comprises an inner ledge and the other pair of attachment rings sits on said inner ledge to provide a seal.

6. A kit for providing a quick release and attachment of a protective garment to protective gloves which comprises a first pair of rings for attachment to the sleeves of said protective garment and a first pair of gloves, and a second pair of rings for attachment to a second pair of protective gloves thicker than said first pair of gloves, one pair of said rings having at least one tab and the other pair of rings having at least one L-shaped slot for receiving said at least one tab to provide a seal between the rings when twisted and means for attaching said gloves and said sleeves to said rings, said second pair of gloves covering said first pair of thinner gloves, and o-rings forming a seal between said first pair of attachment rings and said second pair of attachment rings.

7. The kit of claim 6 including an adhesive.

8. The kit of claim 6 wherein one pair of rings comprises an inner ledge and the other pair of rings can sit on said inner ledge to provide a seal when joined.

9. The kit of claim 6 including clamping means for holding said gloves on rings.

10. The kit of claim 6 including clamping means for holding a ring on the bottom of a sleeve.

11. The kit of claim 6 including attachment means for a third pair of gloves to replace said second pair of gloves.

12. The kit of claim 6 including a tape.

* * * * *